United States Patent [19]

Aikioniemi

[11] Patent Number: 4,971,531

[45] Date of Patent: Nov. 20, 1990

[54] PUMP ARRANGEMENT DRIVEN BY COMPRESSED-AIR

[75] Inventor: Vilho Aikioniemi, Eskilstuna, Sweden

[73] Assignee: AB Nike, Eskilstuna, Sweden

[21] Appl. No.: 426,711

[22] Filed: Oct. 26, 1989

[30] Foreign Application Priority Data

Oct. 28, 1988 [SE] Sweden ..... 8803868

[51] Int. Cl.[5] ..... F04B 17/00; F04B 35/00

[52] U.S. Cl. ..... 417/401; 91/287; 91/303; 91/312; 417/252

[58] Field of Search ..... 417/252, 401; 91/286, 91/287, 303, 312

[56] References Cited

U.S. PATENT DOCUMENTS 4,042,311 8/1977 Yonezawa .

*Primary Examiner*—Gerald A. Michalsky

*Attorney, Agent, or Firm*—Roylance, Abrams, Berdo & Goodman

[57] ABSTRACT

A compressed air pump comprising a compressed air piston motor (11) having a cylinder housing (12) and a low pressure piston (22) moveable between first and second end wall parts (13, 14) and a hydraulic piston pump (15) in the second end wall part (14). One side of the low pressure piston and the first end wall part together define a working chamber (21) and the other side of the piston (22) abuts and drives the hydraulic piston (24). A pilot piston (25), which is controlled by the low pressure piston (22) controls the supply of compressed air to the working chamber (21). A spring powers the return stroke of the low pressure piston and the hydraulic piston. The pilot piston (25) is housed in a pilot cylinder (35) incorporated in the first end wall part (13) and is mounted for movement between a first position and a second position. In the first position compressed air can be passed from an inlet (17) in the end wall part to the working chamber. In the second position the supply of compressed air is interrupted and an outlet opening (31) located between the working chamber (21) and an outlet (32) is opened so that return air can be evacuated. The pilot piston (25) has mounted therein a control piston (26) which is connected to the low pressure piston (22) and which controls the pilot piston to cause it to move from the first to the second position by opening a compressed air connection (41) to the pilot piston's working chamber (36).

8 Claims, 2 Drawing Sheets

PUMP ARRANGEMENT DRIVEN BY COMPRESSED-AIR

SUMMARY OF THE INVENTION

The present invention relates to a pump arrangement driven by compressed air. The invention comprises a compressed air piston motor having a cylinder housing and a low-pressure piston which is moveable between a first and a second end-wall part. A hydraulic piston pump is incorporated in the second end-wall part. One side of the low-pressure piston and the first end-wall part define a working chamber in the piston motor. The other side of the piston abuts against and drives the hydraulic piston of the hydraulic pump. The invention pump arrangement further comprises a pilot piston which is controlled by the low-pressure piston and which functions to control the supply of compressed air to the working chamber A spring device for effecting the return stroke of the low-pressure piston and the hydraulic piston is also provided.

BACKGROUND OF THE INVENTION

Compressed air hydraulic pump arrangements of this kind are used in many connections, e.g., to convert available compressed air energy into energy in the form of a much higher hydraulic pressure. An increase in pressure of from 6 to 600 kp/cm$^2$ can readily be achieved, to drive different types of pneumatic press tools, jacks, and the like. Although such pump arrangements function satisfactorily in the main, they have certain drawbacks when higher demands are placed on their reliability and operational economy. For instance, their efficiency is not particularly high. Also, guidance of the air piston is relatively inaccurate, which means that the points at which the piston turns at the end of a working stroke varies in an undesirable manner. This variation in the turning positions of the piston can result in serious damage to the hydraulic pump, particularly if it is a two-stage pump working at high pressure.

ADVANTAGES AND OBJECTS OF THE INVENTION

Consequently, one object of the invention is to provide a compressed air hydraulic pump arrangement which has a much greater efficiency than known pump arrangements of this kind and in which movement of the air piston is controlled much more accurately than heretofore. Another object is to provide a pump arrangement that is more simply constructed and less costly to produce than prior art pump arrangements of this kind, and that can be readily adapted to different desired pump capacities.

SUMMARY OF THE INVENTION

The present invention is based on the realization that greater precision and efficiency can only be achieved when the low pressure piston in the air motor can be controlled in a very precise and reliable manner. This has been achieved in accordance with the present invention by locating the pilot piston in an end-wall part of the cylinder housing and by controlling the piston with the aid of a control piston or control rod rigidly connected to the low-pressure piston and positioned axially in line with the low pressure piston, the pilot piston, and the piston of the hydraulic pump. All the necessary holes and cavities for the controlling channels can then be concentrated in the aforesaid end-wall part, thereby enabling the air-motor piston and the cylinder to be produced without any passages or channels therein, which greatly simplifies the manufacture of these components. The pilot piston is constructed so that the air supply thereto is interrupted when the air motor piston begins its return stroke. This greatly reduces air consumption in comparison with earlier known pump arrangements of this kind, which normally allow the air to pass to atmosphere during the return stroke of the piston.

BRIEF DESCRIPTION OF THE FIGURES OF THE DRAWING

The above and other features and advantages of the inventions will be clearly understood from a reading of the following detailed description and claims in conjunction with the accompanying drawing also forming a part of this disclosure, in which

DETAILED DESCRIPTION OF THE PREFERRED EMBODIMENT

Figure 2:
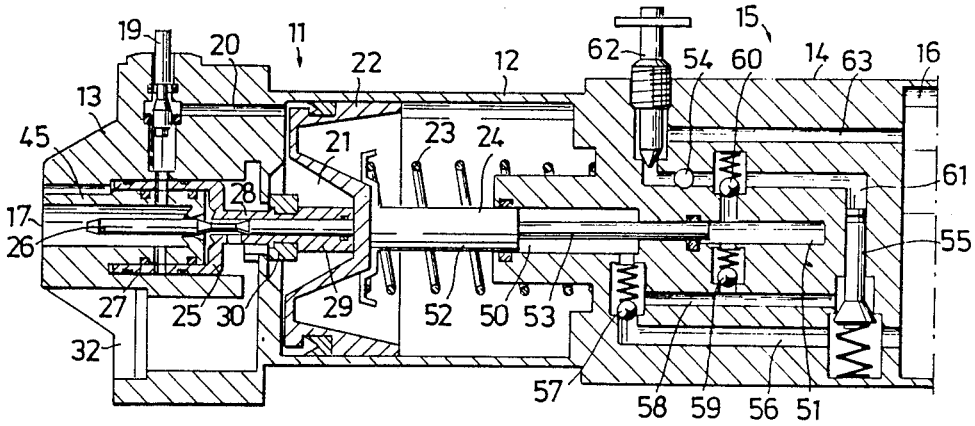
FIGS. 2–5 are cross-sectional views of the pump arrangement according to FIG. 1, showing it during different stages of operation.

The illustrated pump arrangement includes a pneumatic piston motor 11 having a cylinder housing 12 and a first and a second end wall part 13, 14. A piston pump, generally shown at 15, is accommodated in the second end-wall part 14, together with a hydraulic oil tank 16. The pump arrangement is intended to be driven from an external source of compressed air (not shown) via a connection device coupled to an inlet 17. The pump arrangement is operated by means of a foot pedal 18, which functions to open and close a main valve 19. The main valve is mounted in an inlet conduit 20 located in the first end-wall part 13, at a position between the inlet 17 and the working chamber 21 of the piston motor 11. The working chamber 21 is defined by a low-pressure piston 22, which is moveable between first and second end positions shown in FIGS. 2 and 3 respectively. Mounted between the piston 22 and the second end wall part 14 is a spring device 23, which in the case of the illustrated embodiment has the form of a coil spring and which functions to move the piston to its first end position (FIG. 2). The piston pump 15 includes a hydraulic piston 24 which abuts the low pressure piston 22 and reciprocates together with said piston 22.

This movement is controlled or governed by means of a pilot piston 25 mounted in the first end wall part 13 and a control piston or control rod 26 located between the pilot piston 25 and the low pressure piston 22. The pilot piston 25 has a base part 27 in the form of a straight, open cylinder, a neck part 28 which extends axially from the cylindrical part 27, and a head part 29 which extends into the working chamber 21. Head 29 closes an outlet opening 31 located between the working chamber 21 and the outlet 32 of the motor with the aid of a seal 30. The base part 27 has an inlet opening 33 formed therein (FIG. 3) which is effective in alternately opening and closing a connection 48 between the inlet 17 and the inlet conduit 20. This switching between the opened and closed positions of the connection 48 is achieved by virtue of the fact that the base part 27 is moveable axially in a tubular space 34 in the end-wall part 13. The space opens into a pilot cylinder 35 which on one side of the pilot piston communicates with the outlet opening 31 and on the other side of said piston defines a pilot working chamber 36. The control piston or rod 26 is accommodated in an elongated bore 37 which extends through the neck and head parts of the pilot piston 25. The control piston 26 is configured with upper and lower cylindrical parts 38, 39, which fill the bore 37 so as to seal the same, and with an intermediate waist portion 40 of smaller diameter than said upper and lower parts. The upper bore sealing part 38 is connected rigidly to the low pressure piston 22, or is attached thereto in some suitable manner, and consequently the control piston 26 will accompany the reciprocating movement of the low pressure piston 22. The control piston 26 functions to control the movement of the pilot piston 25, firstly by opening and closing a pressure connection 41 between the pilot working chamber 36 and the inlet 17, and secondly by opening and closing an outlet connection 42 located between said pilot working chamber 36 and the outlet 32. The free end 43 of the control piston can be drawn out of abutment with a resilient collar 44 located on a connecting part 45 adjacent the inlet 17 and the outlet connection 42, such as to bring the waist part 40 into registry with a hole 46 in the neck part 28 of the pilot piston to create said air connection 41.

The pump 15 is a two stage pump and includes a first working chamber 50 of a relatively large cross-sectional area, and a second working chamber 51, whose cross-sectional area is smaller than that of the first chamber 50. Correspondingly, the pump piston 24 has an inner piston 52 of relatively larger diameter from which there extends an outer piston 53 of smaller diameter. Hydraulic fluid is pumped by the hydraulic pump 15, from the tank 16 to an external pressure connection (not shown) coupled to a connecting passage 54. Activation of the working chamber is effected with the aid of a spring biased servo-piston 55, under the influence of the pressure in the connecting passage 54. FIG. 2 illustrates the servo-piston 55 in its low pressure position, in which hydraulic fluid is drawn from the tank 16 and passed to the first and the second working chambers 50, 51 through channel 56 and check valves 57 and 59. During the working stroke, moving from the FIG. 2 to the FIG. 3 positions, the hydraulic fluid is forced from both the first and the second working chambers 50 and 51. The flow from the first working chamber 50 is conducted through a passage 58, the second check valve 59 and the second working chamber 51. The outer piston 53 is configured so as to provide a given clearance in the working chamber 51, therewith enabling the fluid to pass through the chamber and out through a third check valve 60 and from there to the connecting passage 54, irrespective of the position of the piston 53 in the chamber 51. The connecting passage 54 communicates with the servo-piston 55 through a channel 61. When the pressure has reached a given value, the servo-piston is urged down to the position shown in FIG. 4. In this state of the system, the inner piston 52 will only circulate hydraulic fluid from the tank 16 in a known manner, whereas useful pump work is effected by the outer piston 53 via the check valves 59 and 60. The pump system also includes a pressure equalizer valve 62 which functions to equalize the pressure through a return line 63 to the tank 16.

OPERATION

Figure 1:
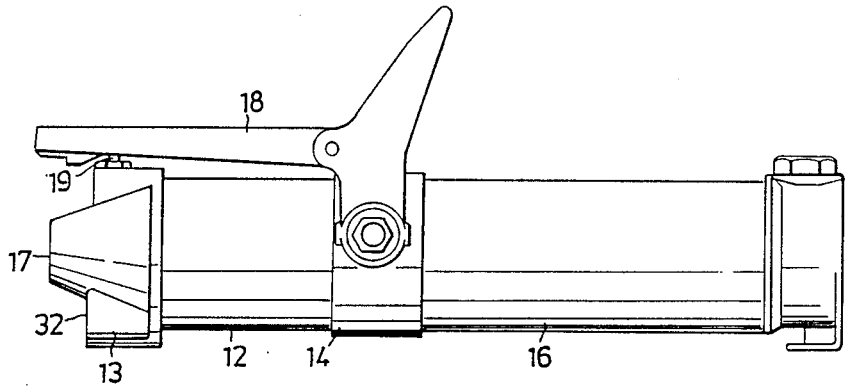
FIG. 1 is a side view of a compressed air driven hydraulic pump arrangement according to the invention.
Figure 3:
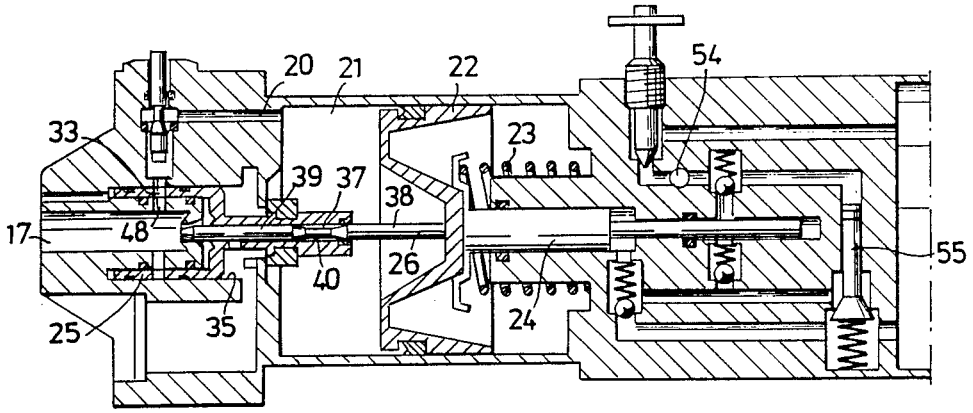
Figure 4:
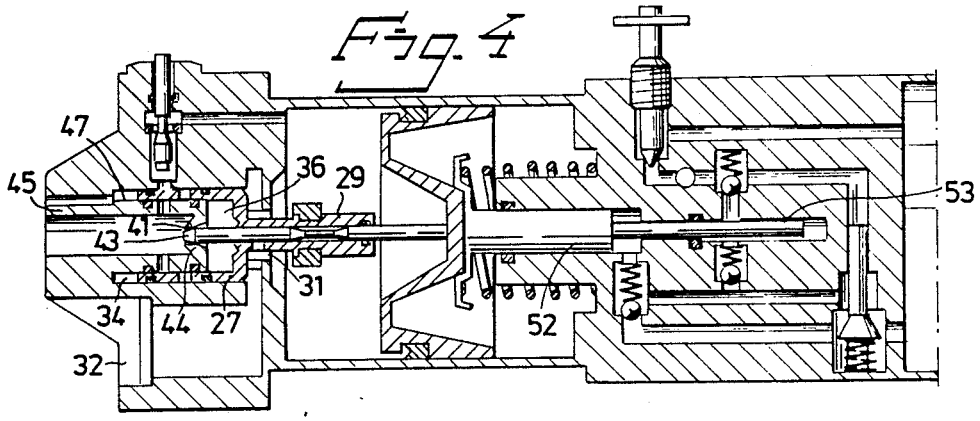
Figure 5:
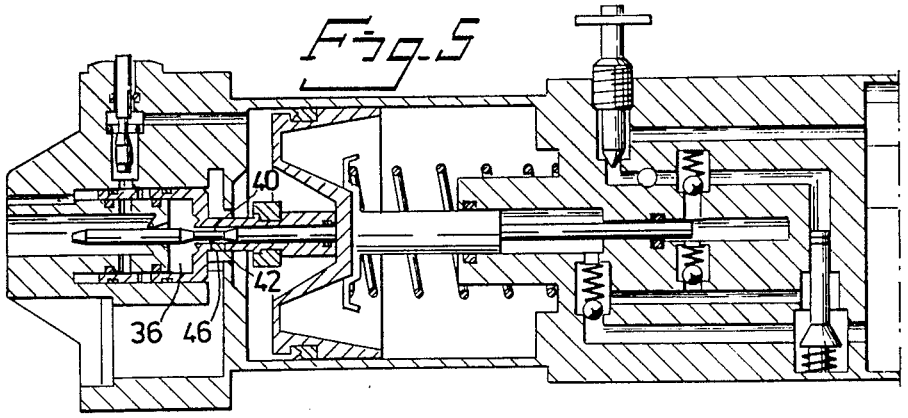

The manner in which the pump arrangement works will now be described with reference to FIGS. 2-5. FIG. 2 illustrates the arrangement in its inoperative state, prior to starting-up, wherein the low pressure piston 22 is located in its first end position and air is able to pass from the working chamber 21 and out through the inlet conduit 20, from whence it is evacuated to atmosphere through the three-way valve 19. FIG. 3 illustrates an operational state of the pump system in which the three-way valve 19 is open. In this state, the low pressure piston 22 is pressed towards its second end position while compressing the spring device 23 and simultaneously causing the hydraulic pump piston 24 to carry out a working stroke. The servo-piston 55 now occupies its low pressure position and consequently both the low pressure and the high pressure pistons 52 and 53 will pump hydraulic fluid to the outlet passage 54. Since the control piston 26 is mounted rigidly on the low pressure piston 22, the control piston 26 will be displaced whereas the pilot piston 25 will be held in the illustrated position by the pressure in the working chamber 21. When the low-pressure piston 22 has reached its second end position, the control piston 26 exposes the compressed air connection 41 adjacent the resilient collar 44 in the connecting piece 45, so that the pilot working chamber 36 can be placed under pressure. Since the pressurized surface on the base part 27 is greater than the holding pressure on the head part 29, the pilot piston 25 will be moved to its second end position shown in FIG. 4. The pilot piston 25 thus opens the outlet opening 31 and places the working chamber 21 in communication with the outlet 32. The connection 48 to the inlet conduit 20 is closed at the same time, so that the introduction of compressed air is interrupted during the return stroke of the low pressure piston 22. If a higher hydraulic pressure is now reached in the pressure connection 54, the servo-piston 55 is reset to the high pressure setting, FIGS. 4 and 5, in which case only the high pressure piston 53 will perform useful pump work and the low pressure piston 52 will solely circulate unpressured hydraulic fluid. The return stroke of the low pressure piston 22 is effected with the aid of a coil spring 23, which urges the low pressure piston 22 and the hydraulic pump piston 24 towards the first end position, as illustrated in FIG. 5. This causes the waist part 40 of the control piston 24 to be moved to the FIG. 5 position in front of the hole 46 in the neck part of the pilot piston 25 to thus open the outlet connection 42 between the pilot working chamber 36 and the outlet 32. This enables the low pressure piston 22 to be returned to the starting position shown in FIGS. 1 and 2, by pushing on the head 29 of the pilot piston 25 to close outlet opening 31. The pump arrangement has thus undergone a complete working cycle and, provided that the main valve 19 is kept open, all of the pistons will continue working in the aforedescribed manner.

The aforedescribed highly precise mechanical coupling between the low pressure piston 22 and the control piston 26 and pilot piston 25 respectively results in very precise control of the two end positions of the low pressure piston 22. As mentioned above, such control is highly beneficial with respect to the hydraulic piston pump 15, since precise piston turning positions are a prerequisite of optimum pump operation and efficiency. Furthermore, the pump components are relatively easy to manufacture and machine. For example, the pilot piston 25 can be produced from any suitable plastic material and the cylinder housing 12 can be given a simple tubular form without needing to machine it in any particular manner or provide it with channels or passages. All such machining is instead concentrated on the first end wall 13, which greatly simplifies the work of manufacture and enables one and the same end wall structure to be used with pump arrangements of different capacities. For example, pumps of different capacities can be produced simply by using cylindrical tubes 12 of different lengths and, at the same time, adapting the lengths of the control piston 26 and the hydraulic-pump piston 24 to the length of the tube 12.

Finally, it is emphasized that the illustrated and described pump arrangement is solely a preferred embodiment of the invention and that modifications can be made within the scope of the following claims.

What is claimed is:

1. A compressed air driven pump arrangement comprising a compressed air piston motor and an hydraulic piston pump, said pump arrangement comprising first and second end wall parts and a cylinder housing therebetween, means to supply compressed air to said compressed air piston motor and means to vent said air from said compressed air piston motor, said compressed air piston motor comprising a low pressure piston movable in said cylinder housing between said first and second end wall parts in a power stroke in one direction and in a return stroke in the other direction and means housing substantially all other portions of said compressed air piston motor in said first end wall part, means housing substantially all of said hydraulic piston pump in said second end wall part, said low pressure piston comprising a first side and a second side, said compressed air piston motor comprising a working chamber defined by said first side of said low pressure piston and said first end wall part, said hydraulic piston pump comprising hydraulic piston means cooperable with hydraulic chamber means formed in said second end wall part, said low pressure piston and said hydraulic piston means being so arranged that said hydraulic piston means abuts said second side of said low pressure piston, said compressed air piston motor further comprising a pilot piston and a control piston, means to join said control piston to said low pressure piston at said first side thereof, said first end wall part being formed with a pilot cylinder in which said pilot piston is fitted for movement between a first position and a second position, means to fit said control piston for motion within said pilot piston, said pump arrangement further comprising spring means arranged to effect said return stroke of said low pressure piston and said hydraulic piston means, said compressed air piston motor comprising a pilot piston working chamber defined by said pilot piston and portions of said first end wall part; said hydraulic piston means, said spring means, and said low pressure, pilot and control pistons being so arranged that said control piston causes said pilot piston to move from its first to its second position and said spring means causes motion of said pilot piston from said second to said first position by abutment of said hydraulic piston means against said low pressure piston and said pilot piston; said pilot piston being arranged to supply compressed air from said supply means into and to prevent venting of said air out of said compressed air piston motor low pressure piston working chamber in said first position of said pilot piston and to permit the venting via said vent means of said compressed air out of and to prevent supply of compressed air into said compressed air piston motor low pressure piston working chamber in said second position of said pilot piston, said control piston causing the movement of said pilot piston from said first position to said second position by permitting compressed air from said supply means to enter said pilot piston working chamber, and said control piston further being arranged to permit said low pressure piston to move said pilot piston from said second position to said first position by preventing compressed air from said supply means from entering said pilot piston working chamber and to vent said air from said pilot piston working chamber to said vent means.

2. A pump arrangement according to claim 1, wherein said control piston causes said pilot piston to move from said second position to said first position by closing said compressed air supply means and opening said vent means to said pilot piston working chamber.

3. A pump arrangement according to claim 2, said means to fit said control piston for motion within said pilot piston comprising an elongated bore formed in said pilot piston, and said control piston being formed with a waist portion of reduced diameter, and said waist portion being operative to selectively open and close said vent means with respect to said pilot piston working chamber in response to axial motion of said control piston in said pilot piston elongated bore.

4. A pump according to claim 1, said pilot piston being formed with an axially elongated portion, an aperture formed in said elongated portion, said aperture being operative to selectively open and close a connection between said air supply means and said compressed air piston motor working chamber in response to axial motion of said pilot piston elongated portion.

5. A pump arrangement according to claim 4, said elongated portion of said pilot piston being in the form of a cylinder open at one end, said pilot piston further comprising a head portion adapted to selectively open and close a connection between said compressed air piston motor working chamber and said vent means, said means to fit said control piston for motion within said pilot piston comprising an elongated bore formed in said pilot piston, and said control piston being formed with a waist portion of reduced diameter, said waist portion being operative to selectively open and close said vent means with respect to said pilot piston working chamber in response to axial motion of said control piston in said pilot piston elongated bore, and said elongated bore extending through said head portion.

6. A pump arrangement according to claim 5, said first end wall part being formed with a tubular opening, and said cylindrical portion of said pilot piston being adapted for axial motion in said tubular opening.

7. A pump arrangement according to claim 6, said tubular opening being defined by an end wall formed in said first end wall part, an opening formed in said tubular opening end wall, means to connect said open end of said tubular opening to said compressed air supply means, said control piston extending through said opening in said tubular opening end wall; and said control piston, during a full cycle of one of said power strokes and one of said return strokes, being adapted to alternatively connect said compressed air supply means to said pilot piston working chamber and to seal said connection; said control piston performing the change between said connecting function and said sealing function at the turning point of the motion of said control piston in said full cycle.

8. A pump arrangement according to claim 1, said hydraulic pump comprising a two stage pump comprising said hydraulic piston means and first and second working chambers, said first and second working chambers being arranged in axial alignment with each other with said first chamber having a relatively larger cross-sectional area than the cross-sectional area of said second chamber, said hydraulic pump means comprising first and second piston portions arranged in axial alignment with each other and fitted into operative cooperation with said first and second working chambers respectively, and means to permit both sets of said first and second working chambers with said first and second piston portions therein to be active in said hydraulic pump up to a predetermined hydraulic output pressure and to cause one only of said first and second sets of said first and second working chambers with said first and second piston portions therein to be active in said hydraulic pump at output pressures above said predetermined pressure.

* * * * *